US008994278B2

(12) United States Patent
Grebner et al.

(10) Patent No.: US 8,994,278 B2
(45) Date of Patent: Mar. 31, 2015

(54) DEVICE FOR CONTROLLING AN ELECTRICAL LOAD

(75) Inventors: Klaus-Dieter Grebner, Markt Rodach (DE); Michael Reier, Pressig (DE)

(73) Assignee: Lear Corporation GmbH, Kronach (DE)

( * ) Notice: Subject to any disclaimer, the term of this patent is extended or adjusted under 35 U.S.C. 154(b) by 682 days.

(21) Appl. No.: 13/044,954

(22) Filed: Mar. 10, 2011

(65) Prior Publication Data

US 2012/0139428 A1 Jun. 7, 2012

(30) Foreign Application Priority Data

Mar. 10, 2010 (DE) ..... 10 2010 015 908

(51) Int. Cl.
*H05B 37/00* (2006.01)
*H05B 33/08* (2006.01)

(52) U.S. Cl.
CPC ..... *H05B 33/083* (2013.01); *H05B 33/0809* (2013.01)
USPC ..... 315/186; 315/306; 315/360

(58) Field of Classification Search
USPC ..... 315/185 R, 186, 188, 291, 306, 307, 360
See application file for complete search history.

(56) References Cited

U.S. PATENT DOCUMENTS

| | | | | |
|---|---|---|---|---|
| 3,969,672 | A * | 7/1976 | Wallander et al. | 324/133 |
| 7,564,198 | B2 * | 7/2009 | Yamamoto et al. | 315/307 |
| 8,174,212 | B2 * | 5/2012 | Tziony et al. | 315/309 |
| 8,344,633 | B2 * | 1/2013 | Van Woudenberg et al. | 315/186 |
| 2004/0090403 | A1 * | 5/2004 | Huang | 345/82 |
| 2005/0231459 | A1 * | 10/2005 | Furukawa | 345/102 |
| 2008/0258647 | A1 * | 10/2008 | Scianna | 315/291 |
| 2009/0167186 | A1 * | 7/2009 | Ghanem | 315/77 |
| 2009/0251065 | A1 | 10/2009 | Niedermeier et al. | |
| 2010/0013411 | A1 | 1/2010 | Krespach et al. | |
| 2011/0025216 | A1 * | 2/2011 | Ching-Chi et al. | 315/186 |
| 2011/0199003 | A1 * | 8/2011 | Muguruma et al. | 315/122 |

FOREIGN PATENT DOCUMENTS

DE 202007011973 U1 1/2009

* cited by examiner

*Primary Examiner* — Tung X Le
(74) *Attorney, Agent, or Firm* — MacMillan, Sobanski & Todd, LLC

(57) ABSTRACT

A device serves to control an electrical load of at least two single loads connected in series. Each of the at least two single loads is connected in parallel to a controllable switch, so that each of the at least two single loads can be switched independently of one another. In addition, a driver stage that drives a current into the electrical load is present. The controllable switches can be controlled by the control unit. A dummy load is connected in series to the at least two single loads.

23 Claims, 15 Drawing Sheets

DEVICE FOR CONTROLLING AN ELECTRICAL LOAD

BACKGROUND OF THE INVENTION

The present invention relates to a device for controlling an electrical load. The controlled electrical load particularly relates to an arrangement of light-emitting diodes, hereinafter called LEDs, wherein the electrical load must be supplied with a nearly constant operating current.

Constant current sources are preferably used for controlling an electrical load, especially LEDs, LED chains and/or LED arrays. Diverse arrangements of LEDs are known. Besides the parallel arrangement or matrix connection of LEDs, the possibility of series connection of LEDs is also known. In the series connection of LEDs, all LEDs are connected behind one another in a row; this connection is also called an LED chain. To operate this LED chain, a constant current is generated and conducted through the LEDs. A voltage that corresponds to the sum of the forward voltages of all LEDs then arises across the LEDs.

In order to achieve a constant luminous efficiency, the current that flows through the LEDs must be controlled temperature-dependent and be nearly constant. This is achieved in a well-known manner through pulse-width modulation of the supplied current. By means of pulse-width modulation, this modulated current is then used for the brightness control of the LED chain. The energy supply of the LEDs is accomplished by a step-up converter, for example.

An LED cluster arrangement, which is supplied with constant current, is known from DE 20 2007 011 973 U1. The LED cluster arrangement is controlled by pulse-width modulation.

DE 2006 059 355 A1 discloses a control device in a method for operating a series connection of light-emitting diodes.

DE 10 2005 058 484 A1 discloses a circuit arrangement and a method for operating at least one LED.

Voltage and current variations that stress the energy supply unit particularly arise during switching operations, such as switching on/off single LEDs connected in series. The forward voltage, which drops at the LED for a corresponding current, is based on the current-voltage characteristic of a light-emitting diode. A particular minimum voltage is thus first necessary for operation. The LED current is nearly negligible until this minimum voltage is reached, and the light emission is zero or nearly zero.

If the brightness of single LEDs in the series connection is to be influenced, this is accomplished by jumping the LEDs using a switch arranged in parallel to each LED or to an LED group. The switch is advantageously embodied in the form of a semi-conductor switch. The current then flows either through the LEDs whose parallel switch is open or through the closed switches. This switching principle allows the LEDs to be switched on and off as desired.

As long as the number of LEDs remains constant, i.e. a switching operation does not change the number of LEDs switched on, the output voltage that the voltage supply unit must provide will remain unchanged. However, changing the simultaneously driven LEDs presents a problem, because the output voltage needed to operate the new number of LEDs changes and the LED current thus breaks down. If one LED among the operated or already illuminating LEDs is now switched on or off, a considerable voltage peak and a current variation appears. When switching on an LED, a current break therefore occurs at first due to the lack of output voltage and then a voltage peak occurs due to the control response. The result is that the LEDs that are already switched on and illuminating at first become dark and flicker. This must be avoided through a suitable control.

It is therefore the object of the invention to provide a device that handles this problem.

SUMMARY OF THE INVENTION

The present object is achieved on the basis of the characteristics of the claims. Advantageous embodiments of the invention arise on the basis of the dependent claims and from concrete example embodiments based on the figures.

The device according to the invention serves to control an electrical load. The electrical load consists of at least two single loads connected in series. Each of the at least two single loads is connected in parallel to a controllable switch, so that each of the at least two single loads can be switched independently of one another. In addition, a driver stage that drives a current into the electrical load is present. The controllable switches can be controlled by the control unit.

A dummy load is connected in series to the at least two single loads. The current in the operated load is largely held constant. Compensation for load surges, which appear in the form of a voltage peak and a current break when switching one of single loads on or off, is largely provided by means of the dummy load. The dummy load, which is cut in at the time when a single load is cut out and cut out when a single load is cut in, is used for this.

In an advantageous embodiment of the invention, it is provided that the electrical resistance value of the dummy load corresponds to the electrical resistance value of one of the at least two single loads, or that the electrical resistance of the dummy load corresponds to an integral multiple or a fraction of the electrical resistance value of one of the at least two single loads.

In an advantageous embodiment of the invention, it is provided that the dummy load is rated so that at a nominal voltage the dummy load assumes the same electrical variable that corresponds to the operating voltage drop across one of the at least two single loads or to an integral multiple thereof.

In an advantageous embodiment of the invention, it is provided that the dummy load is a static dummy load and has a constant electrical variable and that it is connected in parallel to a controllable switch, which is controlled by the control unit.

In an advantageous embodiment of the invention, it is provided that the dummy load is a dynamic dummy load in the form of a variable electrical variable and its (the dummy load's) electrical variable can be varied by means of the control unit.

In an advantageous embodiment of the invention, it is provided that the electrical variable is the electrical resistance value.

It is advantageous that the control unit closes the controllable switch of the dummy load when it opens one of the controllable switches of the at least two single loads and/or that the control unit opens the controllable switch of the dummy load when it closes one of the controllable switches of the at least two single loads.

Through the reciprocal opening and closing of the controllable switches, the dummy load is used to compensate for the load surges that arise in the form of voltage peaks and voltage breaks when cutting one of the single loads in and out.

In an advantageous embodiment of the invention, it is provided that the control unit performs the closing and opening of the controllable switch of the dummy load simultaneously with the opening or closing of one of the controllable switches of the at least two single loads.

In an embodiment of the invention, it is advantageous that, when closing or opening at last one of the controllable switches of the at least two single loads, the control unit adjusts the dynamic dummy load to the electrical resistance value that corresponds to the electrical resistance value held in the operating state by that of the at least two single loads whose associated controllable switch is closed or opened by the control unit. The dummy load is used to compensate for the voltage peaks and current breaks that arise as a result of opening and closing the controllable switches and the associated cutting in and out of single loads.

In an advantageous embodiment of the invention, it is provided that the control unit performs the initial switch-on and the entire switching off of the at least two single loads individually, sequentially or together or in groups.

According to another embodiment, it is preferred that the control unit uses a current measuring unit to monitor the electrical current flowing in the electrical load at a current measuring point and, by means of a target-performance comparison, uses the driver stage to adjust said electrical current to an adjustable setpoint so that a current that is as constant as possible flows into the electrical load.

In another embodiment, it is preferred that that a single load is a light-emitting diode or a diode array consisting of at least two light-emitting diodes connected in parallel and/or connected in series and/or matrix-connected.

In another embodiment, it is preferred that the control unit is a microprocessor unit or a microcomputer unit or microcontroller unit or a microelectronic unit with a constant operating voltage.

In another embodiment, it is preferred that the static dummy load is another single load or a diode or a light-emitting diode or a bipolar transistor in the form of an npn transistor or a pnp transistor or a field-effect transistor or a control circuit or a combination of a bipolar transistor or a field-effect transistor with an associated control circuit or an electrical resistor.

In another embodiment, it is preferred that the dynamic dummy load is a bipolar transistor, in the form of an npn transistor or a pnp transistor, or a field-effect transistor or a control circuit or a combination of a bipolar transistor or a field-effect transistor with an associated control circuit or an electrical resistor whose electrical resistance value is variable.

In another embodiment, it is preferred that the dynamic dummy load can be controlled by a pulse-width modulation signal and/or that the pulse-width modulation signal can be generated by a port of the control unit. The electrical resistance value that the electrical dummy load assumes can be varied by this signal.

In another embodiment, it is preferred that the dynamic dummy load can be controlled by an analog signal and/or that the analog signal can be generated by a port of the control unit. The electrical resistance value that the electrical dummy load assumes can be varied by this signal.

In another embodiment, it is preferred that electrically operating resistance value of the bipolar transistor and/or the field-effect transistor can be varied by means of the pulse-width modulation signal, which can be supplied to an operational amplifier by an RC element wherein, in the case of the bipolar transistor, the output of the operational amplifier is conducted to the base of the bipolar transistor by a second resistor and, in the case of the field-effect transistor, it is conducted to the gate of the field-effect transistor.

In another embodiment, it is preferred that electrically operating resistance value of the bipolar transistor and/or the field-effect transistor can be varied by the analog control signal that can be supplied to an operational amplifier, wherein in the case of the bipolar transistor, the output of the operational amplifier is conducted to the base of the bipolar transistor by a second resistor and, in the case of the field-effect transistor, it is conducted to the gate.

In another embodiment, it is preferred that the bipolar transistor is connected in the collector circuit and the field-effect transistor is configured as an n-channel field-effect transistor.

In another embodiment, it is preferred that the dynamic dummy load can be flexibly adapted to different electrical loads, and that electrical loads with different voltage drops can be combined.

In another embodiment of, it is preferred that the control unit activates the dynamic dummy load time-displaced before the cut-in of one or more single loads in order to avoid a discontinuous voltage rise.

In another embodiment, it is preferred that the dummy load is suitable not only for compensating for the voltage rise, but also for reducing the output voltage after the cut-off of one or more single loads or loads with different voltage drops.

In another embodiment, it is preferred that the voltage drop on the dynamic dummy load can be changed and/or varied linearly or that the voltage drop on the dynamic dummy load can be changed and/or varied nonlinearly in the form of an S curve, exponentially, logarithmically or step-like.

The invention will be further described in more detail below on the basis of a concrete example embodiment based on FIGS. 1-13. This description of the invention on the basis of concrete example embodiments does not represent any limitation of the invention to one of the example embodiments.

DETAILED DESCRIPTION OF THE PREFERRED EMBODIMENT

Figure 1:
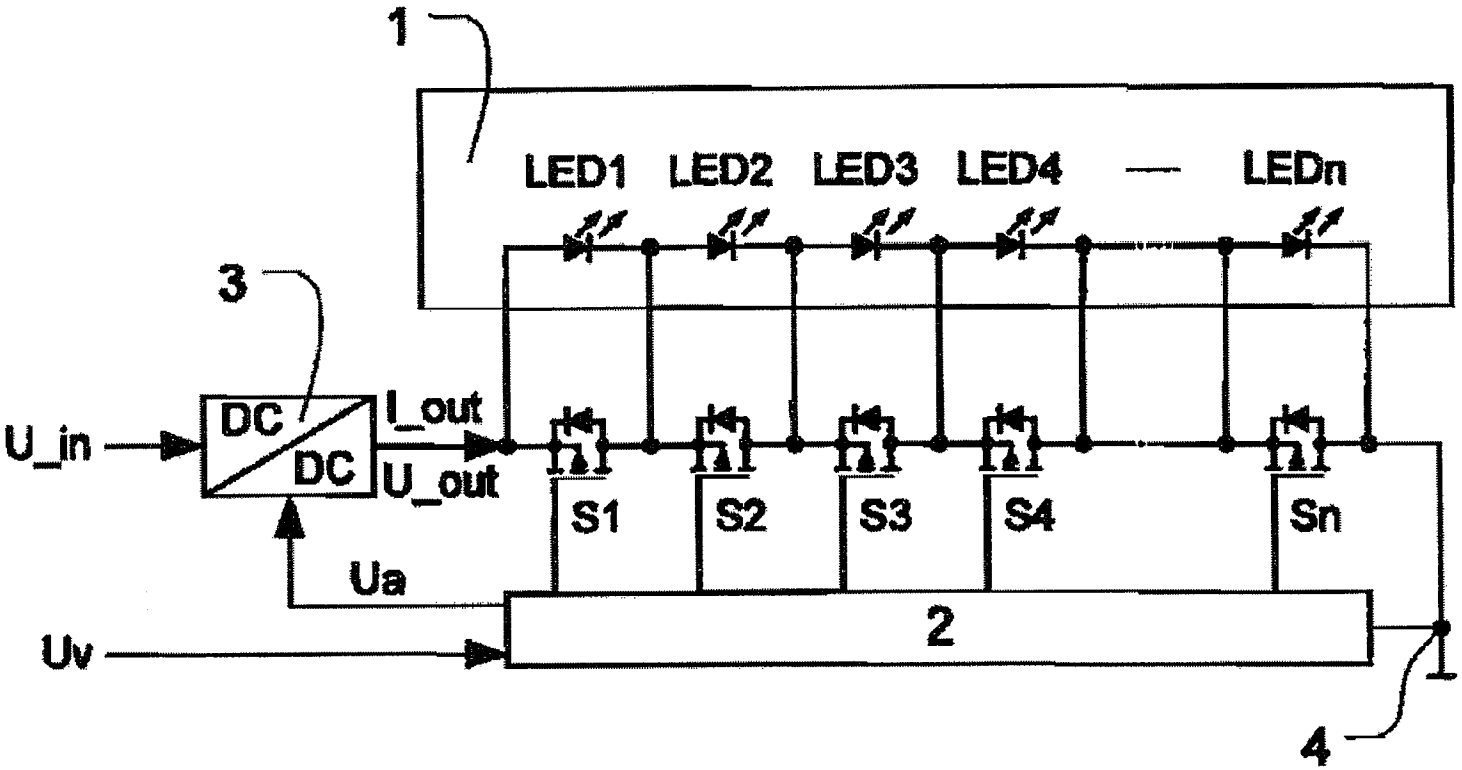
FIG. 1 is a well-known circuit principle for LEDs.

In the following description of the figures, throughout the figures the same reference character will be used in all figures for identical elements in the respective figures. This serves for clarity and better understanding of the further concrete description of the invention based on FIG. 1 to FIG. 15.

FIG. 1 depicts a circuit arrangement for controlling light-emitting diodes. An electrical load 1 is illustrated. The electrical load 1 consists of the single loads LED1, LED2, LED3, LED4 to LEDn. These single loads LED1, LED2, LED3, LED4 to LEDn are connected in series. Each of the single loads LED1, LED2, LED3, LED4 to LEDn represents at least one light-emitting diode.

Light-emitting diodes, especially those with high power, are usually connected in series, operated connected in series and supplied with a constant voltage. The power supply is achieved through a driver stage 3. This driver stage 3 is embodied at least as a constant-current source, preferably in the form of a switching regulator or a DC/DC converter with a constant current output.

Taking the voltage-current characteristic of a light-emitting diode into consideration, there arises a forward voltage, which drops at the light-emitting diode for a corresponding current. Thus a particular minimum voltage is first required for the operation of a light-emitting diode. For light-emitting diodes connected in series, this minimum voltage depends on the number of single loads LED1 to LEDn connected in series. The current I_out, which flows through the single loads LED1 to LEDn, is nearly negligible until this minimum voltage is reached and the light emission from the single loads LED1 to LEDn is nearly zero. If the brightness, i.e. the brightness emission, of the individual single loads LED1 to LEDn arranged in the series connection is to be influenced, then one of the single loads LED1 to LEDn of the electrical load 1 must be jumped. The jumping is performed in such a manner that each of the single loads LED1 to LEDn is respectively connected in parallel to one switch S1 to Sn. Closing the switch S1 to Sn respectively assigned to the single load LED1 to LEDn shunts the corresponding single load LED1 to LEDn. Each of the single loads LED1 to LEDn can be singularly jumped by means of this switch S1 to Sn, which preferably relates to a controllable and/or electronic switch, i.e. each single load LED1 to LEDn can be cut in and cut out individually. To this end, the switches S1 to Sn are embodied as electronic switches which can be switched by the control unit 2. In a preferred embodiment, the electronic switches S1 to Sn relate to field-effect transistors and driver stages, which can be controlled and switched by the control unit 2.

The control unit 2 is supplied with a supply voltage Uv. Moreover, the control unit 2 controls a driver stage 3. The output voltage U_out of the driver stage 3 can be controlled by the control unit 2. To this end, the control unit 2 monitors the current I_out flowing through the electrical load 1 at a current measuring point 4 to which a current measuring unit is connected. The control unit 2 attempts to hold this current nearly constant by closed-loop control using the driver stage 3. The driver stage 3 is supplied by a supply voltage U_in.

The switching principle illustrated in FIG. 1 allows an arbitrary number of single loads LED1 to LEDn to be switched on and off independently of one another. As long as the number of single loads LED1 to LEDn in operation remains constant, i.e. as long as the number of single loads LED1 to LEDn switched on is constant, the output voltage U_out and the output current I_out of the driver stage 3 will remain constant. In an advantageous embodiment of the invention, the control unit 2 controls the driver stage 3 using a pulse-width modulated signal Ua.

Problems will appear during operation, however, if a change is made in the single loads LED1 to LEDn that are switched on, because the output voltage U_out of the driver stage 3 will then change, and the output current I_out, which must be driven through the single loads LED1 to LEDn that are still switched on, thereby nearly breaks down. This problem primarily occurs when another of the single loads LED1 to LEDn connected in series is additionally switched on. When switching on this additional single load LED1 to LEDn, a load surge occurs. The demand for a high constancy of the luminous flux, which is directly proportional to the LED current, is especially problematic because these interruptions clearly make themselves known especially for a short ON duration, i.e. small luminous fluxes.

To henceforth prevent these interruptions, it is provided that another single load LED1 to LEDn cuts in simultaneously when one of the single loads LED1 to LEDn cuts off and vice versa.

During the initial startup of the arrangement or the initial switching on or switching off of the entire electrical unit, the control unit 2 switches on the single loads LED1 to LEDn of the electrical load 1 sequentially or in groups or all together.

Figure 2:
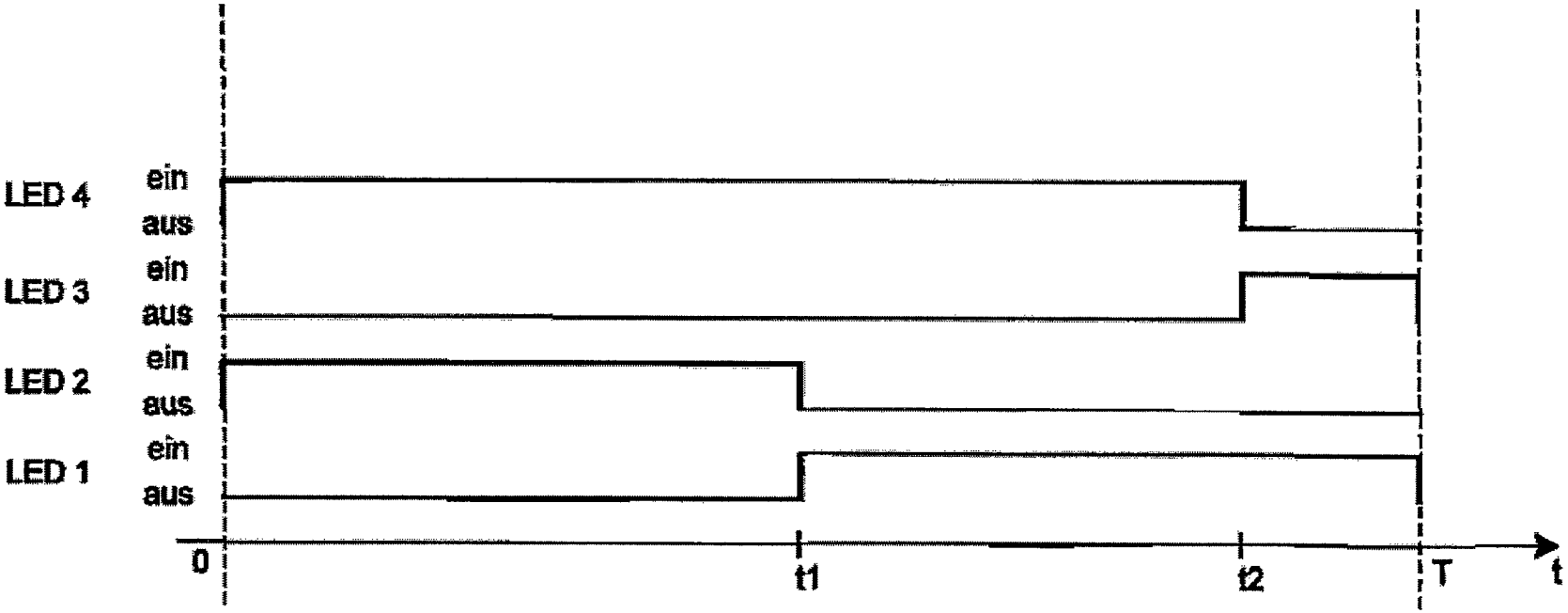
FIG. 2 is a control principle without load surge.

FIG. 2 illustrates such a control principle with prevention of a load surge.

FIG. 2 schematically illustrates four single loads LED1, LED2, LED3, LED4, which represent the electrical load 1 of FIG. 1 for example, and the respective switching state of the single loads LED1, LED2, LED3, LED4 switched "on" and switched "off" one above the other over a time interval 0 to T. But this principle can only be followed with a number of single loads LED1 to LEDn from FIG. 1 whose ON durations, expressed as percentages, add up to an integral multiple of 100%. FIG. 2 therefore depicts four single loads LED1, LED2, LED3, LED4. The single loads LED1, LED2, LED3, LED4 are switched on and off at different times. But another single load LED1, LED2, LED3, LED4 is always simultaneously shut off when one of the single loads LED1, LED2, LED3, LED4 is switched on. The single load LED2 is switched on at time 0, and the single load LED1 is shut off. The single load LED4 is switched on and the single load LED3 is switched off. A load surge is avoided by simultaneously switching on and switching off one single load LED1, LED2, LED3, LED4 at a time. The load surge arising from switching on the single load LED2, LED4 is compensated by switching off the single loads LED1, LED3. Contrarily switching single loads on and off in pairs prevents the load surges that would otherwise appear. The single load LED2 is again switched off at a later time t1. But the single load LED1 is then switched on simultaneously. A load surge is likewise prevented in this case. To henceforth likewise prevent a load surge at a later time t2 when the single load LED4 is to be switched off, the single load LED3 is switched on simultaneously.

In the embodiment with the control principle as per FIG. 2, the separate single loads LED1 to Led4 are controlled by a pulse-width modulated signal. But it is essential that two single loads LED1, LED2, LED3, LED4 at a time be alternatingly driven in one control interval, illustrated in FIG. 2 as the period 0 to T, to prevent a load surge. This control principle permits flexible operation of the single loads LED1, LED2, LED3, LED4 with a nearly constant electrical voltage. The driver stage 3 from FIG. 1 can then be designed for a maximum output voltage of U_out, which is smaller than the sum of the single voltage drops across the single loads LED1 to LEDn, which may be switched on together. But it is necessary to require that the sum of the turn-on times of all single loads to be switched on during a cycle duration does not exceed a particular maximum.

But a problem arises when the sum of the turn-on times of all single loads to be switched on during a cycle duration does not equal an integral multiple of the cycle duration. In the embodiment according to FIG. 2, the turn-on times of the single loads LED1 and LED2 and of LED3, LED4 respectively, each fill the entire cycle duration. The desired current therefore remains constant.

Figure 3:
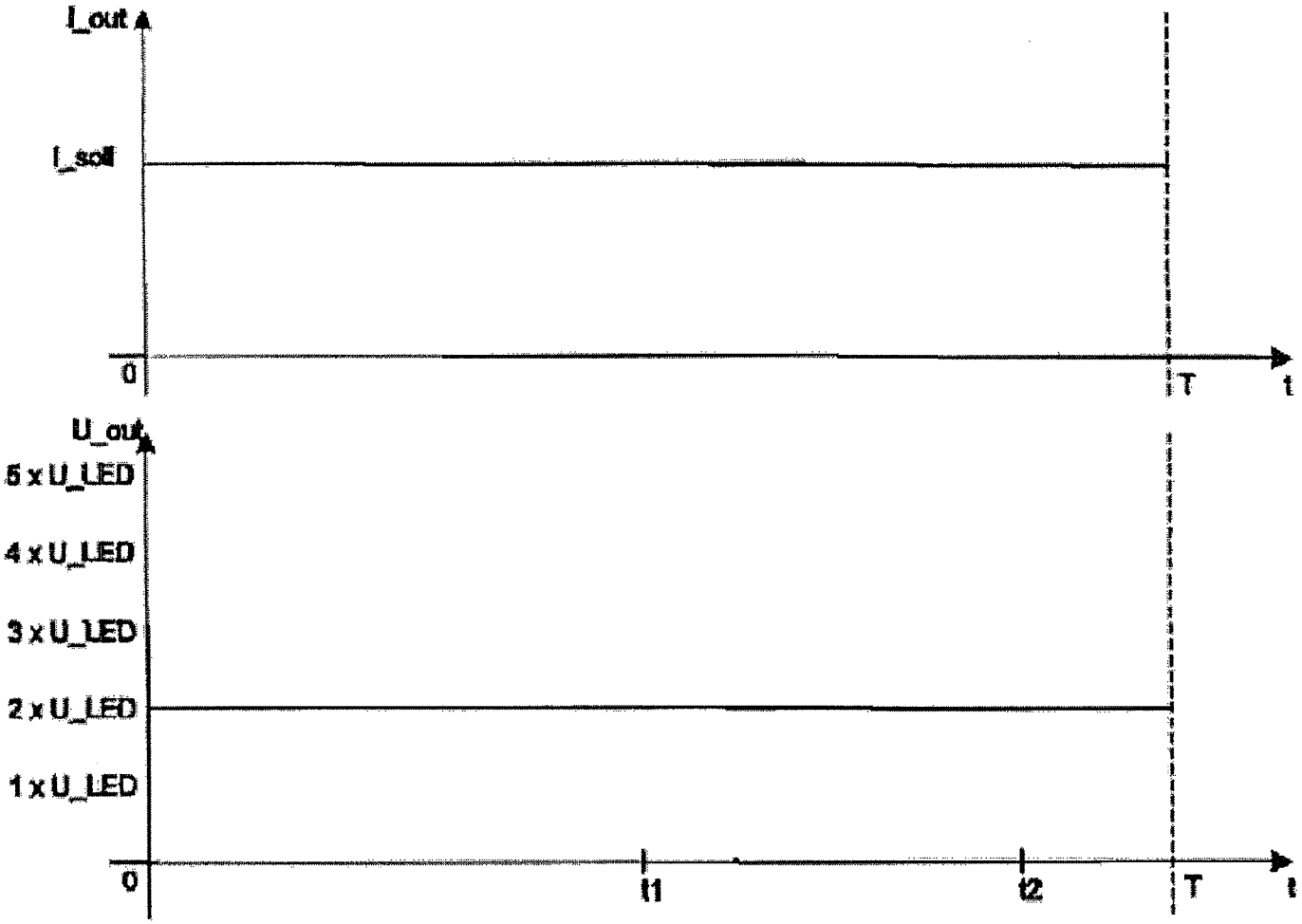
FIG. 3 is the current curve and voltage curve without load surge.

FIG. 3 depicts the electrical voltage, which drops across the electrical load 1 and thus across the single loads LED1 to LED4 from FIG. 2, as voltage value U_out over the cycle duration 0-T. The voltage U_out in FIG. 3, which is provided by the driver stage 3, corresponds to the voltage drop across the switched-on single loads LED1 to LED4. FIG. 3 shows the curve of the current I_out, which flows through the electrical load 1 during the cycle duration 0-T, above the voltage U_out. Since two single loads at a time are switched on over the entire cycle duration 0-T in FIG. 2, the voltage U_out amounts to the sum of the two partial voltages that each drop across one of the single loads LED1, LED2, LED3 and LED4. The current I_out, which flows through the electrical load 1, is likewise constant. The simultaneous switching of two loads on and off prevents a load surge, which is connected with a voltage rise and a current break. The driver stage 3 hardly has to correct. Flickering is prevented when light-emitting diodes are controlled as single loads LED1 to LED4. FIG. 3 illustrates that no variation of the desired current I_desired and electrical voltage U_out arises at the cut-in points t1, t2.

Figure 4:
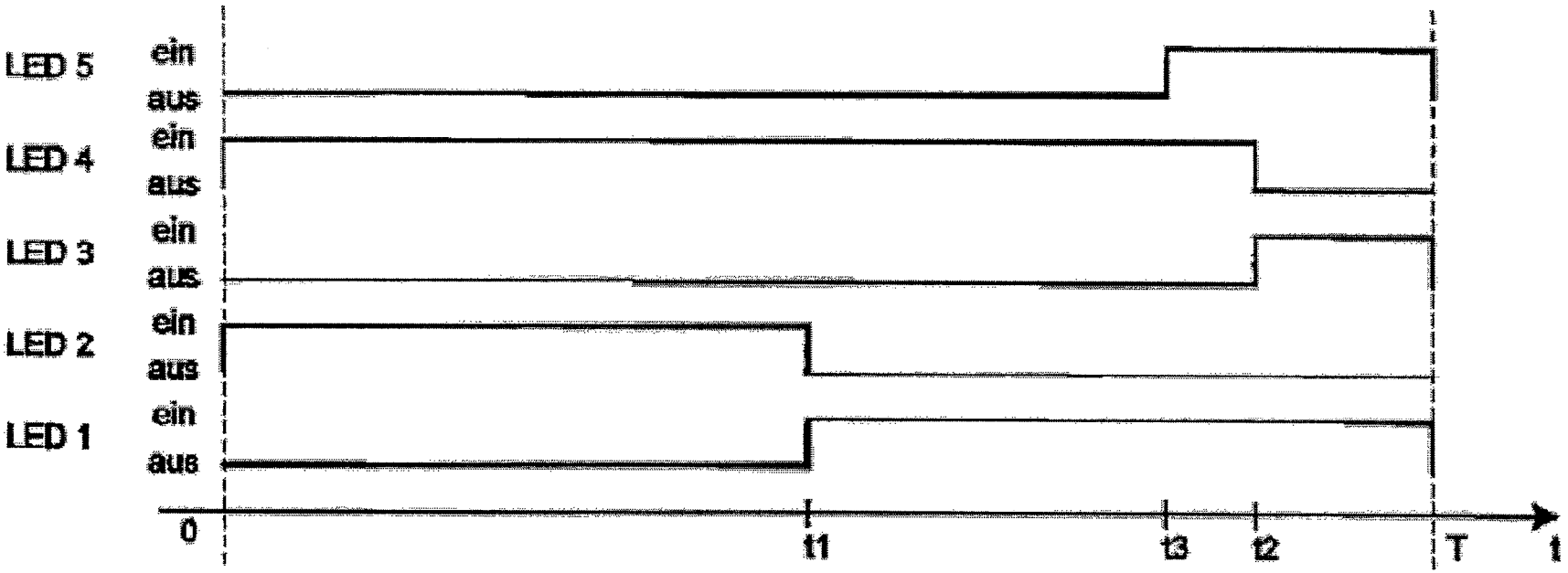
FIG. 4 is a control principle with load surge.
Figure 5:
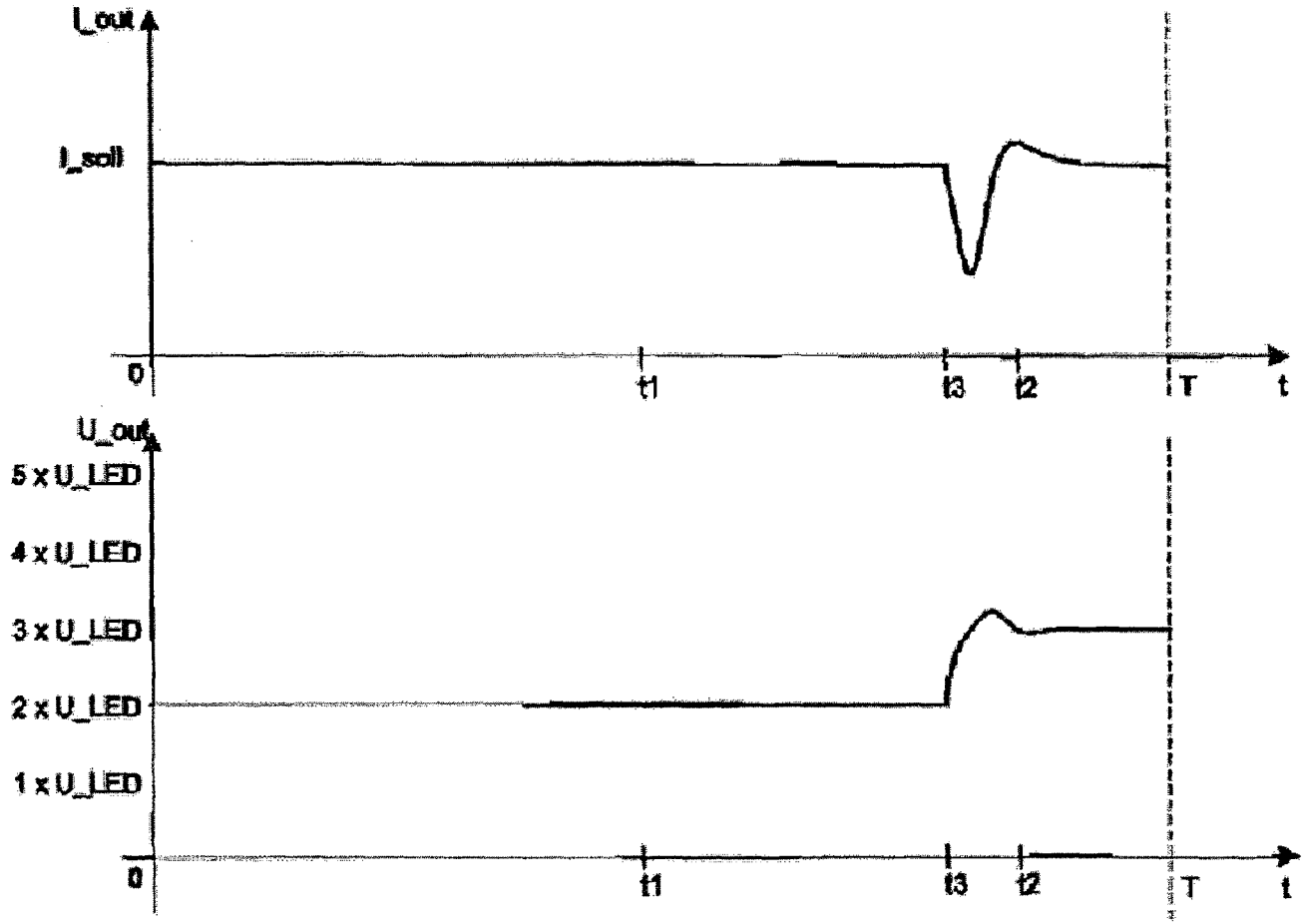
FIG. 5 is a transient response when cutting in a single load.

FIG. 4 schematically illustrates five single loads LED1, LED2, LED3, LED4, LED5, which represent the electrical load 1 of FIG. 1, one above the other and the respective switching state of the single loads LED1, LED2, LED3, LED4, LED5 switched "on" and switched "off" over a time interval 0 to T. In contrast to the embodiment in FIG. 2, the sum of the ON durations of the light-emitting diodes LED1 to LED5 expressed as percentages is not an integral multiple of 100%. The problem of a load surge now arises if another single load, namely the single load LED5, is to be switched on or off and no other single load can be switched contrarily. If the single load LED5 is now to be switched on, e.g. at time t3, then the load surge causes a problem. FIG. 4 depicts this. The single loads LED1 to LED4 are switched on and off similarly as in the embodiment of FIG. 2, without load surge. FIG. 5 illustrates the effect on the voltage and current curves caused by switching on the single load LED5.

FIG. 5 illustrates the voltage U_out and the current I_out versus time. As now quite evident, the current I_desired first dips at time t3, the time at which the single load LED5 is switched on. The voltage U_out rises by more than one LED forward voltage and then levels off at the new voltage value. In a certain period the current I_out also levels off again to the setpoint I_desired. If the single load LED5 is switched on for the time T−t3 with 0<t3<T, a load surge arises. The output voltage U_out of the driver stage 3 now divides itself to the active single loads LED1, LED3, LED5. Since the voltage U_out applied to the separate active single loads LED1, LED3, LED5 has dropped, a smaller current I_out flows through the active single loads LED1, LED3, LED5 in correspondence to the voltage-current characteristic. The control unit 2 now corrects the current I_out back to the target level and the output voltage U_out rises until the desired current reestablishes itself. The correction to the new voltage value takes place more or less quickly with corresponding transient response, independently of the technical design of driver stage 3. This causes flickering when light-emitting diodes are used as single loads LED1 to LED5.

But it is essential that the interruption of the current I_out in this case affects not only one, but all of the single loads LED1, LED4, LED5 that are driven and active at this time. The effect is all the more strongly observed, the fewer single loads are driven at the same time. If, for example, another single load is switched on when operating ten single loads, which are embodied in the form of light-emitting diodes and then correspond to a total voltage of 25 V for ten single loads of ten times 2.5 V, so that eleven single loads are then switched on, the applied voltage of 25V first divides itself in equal parts to all eleven single loads when the eleventh single load is switched on so that the voltage then drops to 2.27 V on each single load. The current flowing through each of the single loads then reduces itself in correspondence with the voltage-current characteristic. If this scenario is observed with a change from one to two single loads, then only 1.25 V is applied to each single load, a result which is actually tantamount to an interruption of the current. The light-emitting diodes are then at first dark and quasi shut off for a user.

Since each change in the current through the single loads when using light-emitting diodes is associated with a corresponding change in brightness, the transient phenomenon means a deviation in the desired brightness. This effect is all the stronger, the shorter the ON duration of the LEDs switched on in the transient region, time interval t3 to t3+Treg, where Treg is the duration of time for the correction to the new desired voltage.

The change in brightness makes itself noticeable as a distinct flickering when the switching times within the transient region shift, e.g. by switching on additional light-emitting diodes or changing the ON durations of the light-emitting diodes.

Figure 6:
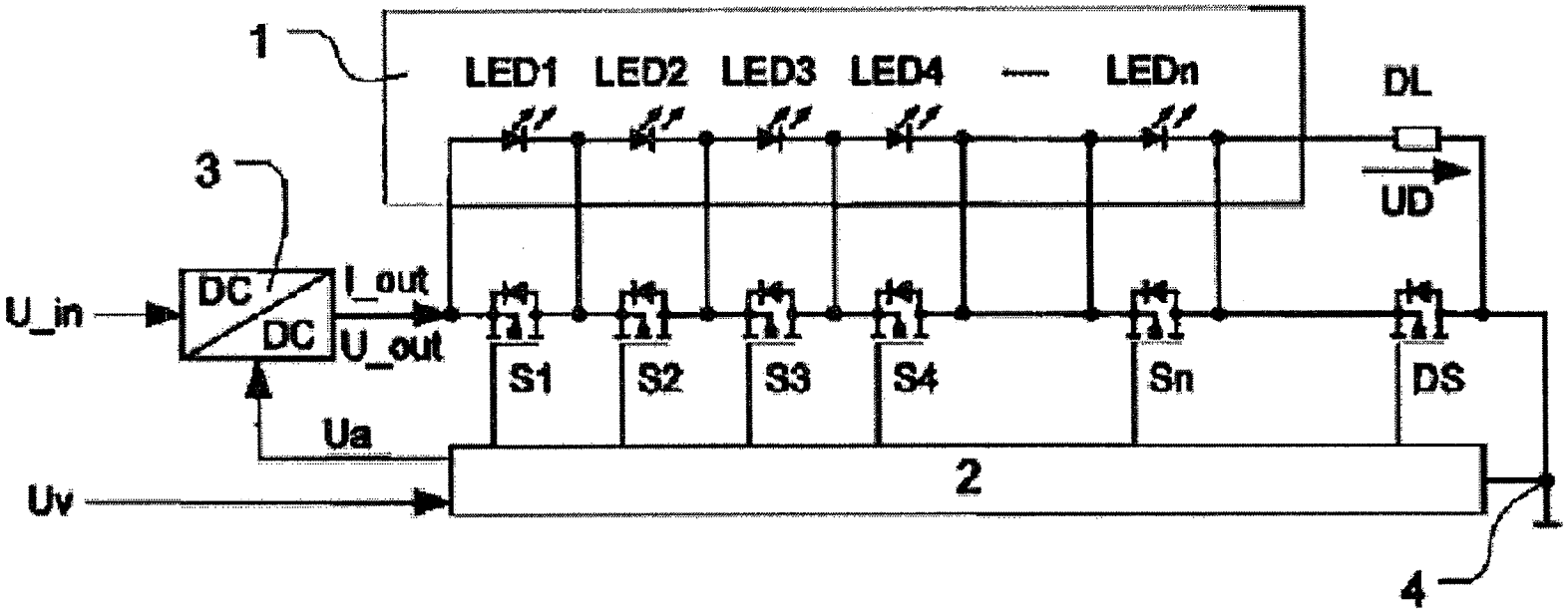
FIG. 6 is a circuit arrangement with a static dummy load.

This problem is now eliminated in accordance with the embodiment in FIG. 6. A dummy load DL is connected in series with the single loads LED1 to LEDn of electrical load 1. The embodiment of the device as per FIG. 6 is identical to the circuit arrangement in FIG. 1 except for the dummy load DL and the controllable switch DS connected thereto in parallel and its control by control unit 2. We therefore refer to the embodiments in regard to FIG. 1. The dummy load DL is again switched by the electronically controllable switch DS. The dummy load DL is now controlled in such a manner that no load variation will occur in the time 0 to T. To this end, the voltage drop UD across the dummy load DL is precisely measured so that it assumes the same magnitude at nominal current as the voltage drop across one of the single loads LED1 to LEDn. The dummy load DL thus counteracts the load surge when switching a single load on or off.

In an advantageous embodiment of the invention, the turn-on time of the dummy load DL is determined such that the entire ON duration of all single loads LED1 to LEDn adds up to an integral multiple of T, i.e. the cycle duration.

Figure 7:
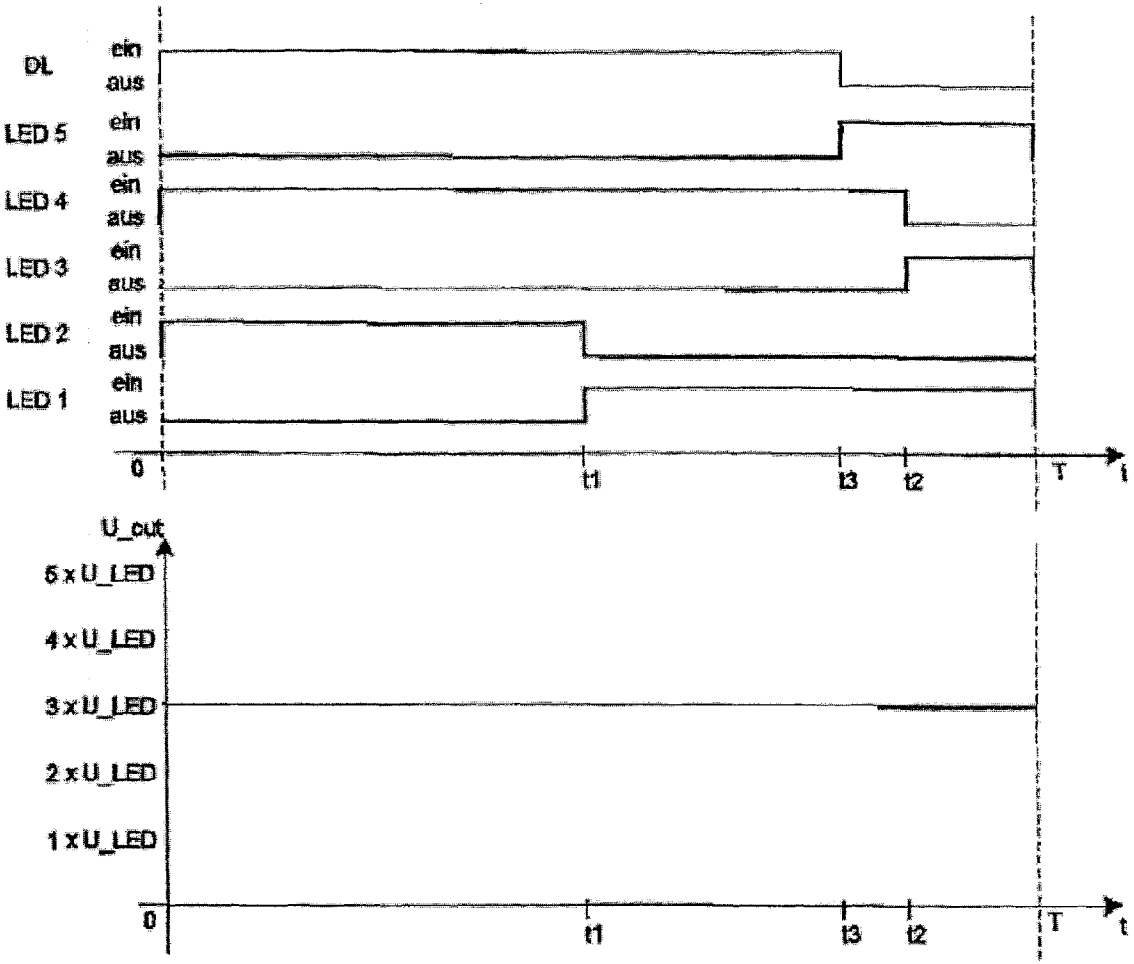
FIG. 7 is signal curves with a static dummy load.

FIG. 7 illustrates the states of five single loads LED1 to LED5 similarly as in FIG. 4. But the dummy load DL is also depicted.

The electrical voltage, which drops across the electrical load 1 and therefore across the single loads LED1 to LED5 and the dummy load DL of FIG. 6, is illustrated as voltage value U_out over the cycle duration 0-T. The voltage drop U_out in FIG. 7 corresponds to the voltage drop across the switched-on single loads LED1 to LED5 and the dummy load DL. The simultaneous switching on and off of two single loads LED1 to LED4 prevents a load surge, which is connected with a voltage rise and a current break. To nevertheless suppress the load surge that appeared at time t3 in FIG. 4 and FIG. 5, the dummy load DL is used when the fifth single load LED5 is switched on. Control unit 2 controls the dummy load DL in such a manner that it is simultaneously switched off at time t3 when the single load LED5 is switched on and simultaneously switched on at time T when single load LED5 is switched off. A load surge is prohibited in this manner and the driver stage 3 hardly has to correct. Flickering is prevented when the light-emitting diodes are controlled as single loads LED1 to LED5.

In an advantageous embodiment of the invention, the driver stage 3 is embodied as a driver unit.

FIG. 7 depicts the states of the single loads LED1 to LED5 and the dummy load DL underneath one another versus time. Underneath, it depicts the curve of the voltage U_out, which drops across the single loads LED1 to LED5 and the dummy load DL. It can henceforth be seen that, when LED 5 is added and the dummy load DL is switched contrary to the switching on and switching off of LED5, the voltage U_out remains nearly constant.

As illustrated in FIG. 7, the dummy load DL and its intelligent control by control unit 2 permits a homogenous loading of the driver stage 3. Current breaks and a consequent reduced light output are prevented.

Implementation in a simple manner is possible; in the simplest case the dummy load DL relates to a resistor that is arranged on the control unit together with a transistor connected in parallel. In another embodiment, the dummy load DL is realized in the form of a semiconductor. For example, another single load could be used in the form of a light-emitting diode or a group of light-emitting diodes, which however does or do not contribute to the generation of light. Alternatively, a field-effect transistor or a transistor which can be operated in the linear range can be used as dummy load DL. In another alternative embodiment, an operational amplifier circuit is used as dummy load DL.

Figure 8:
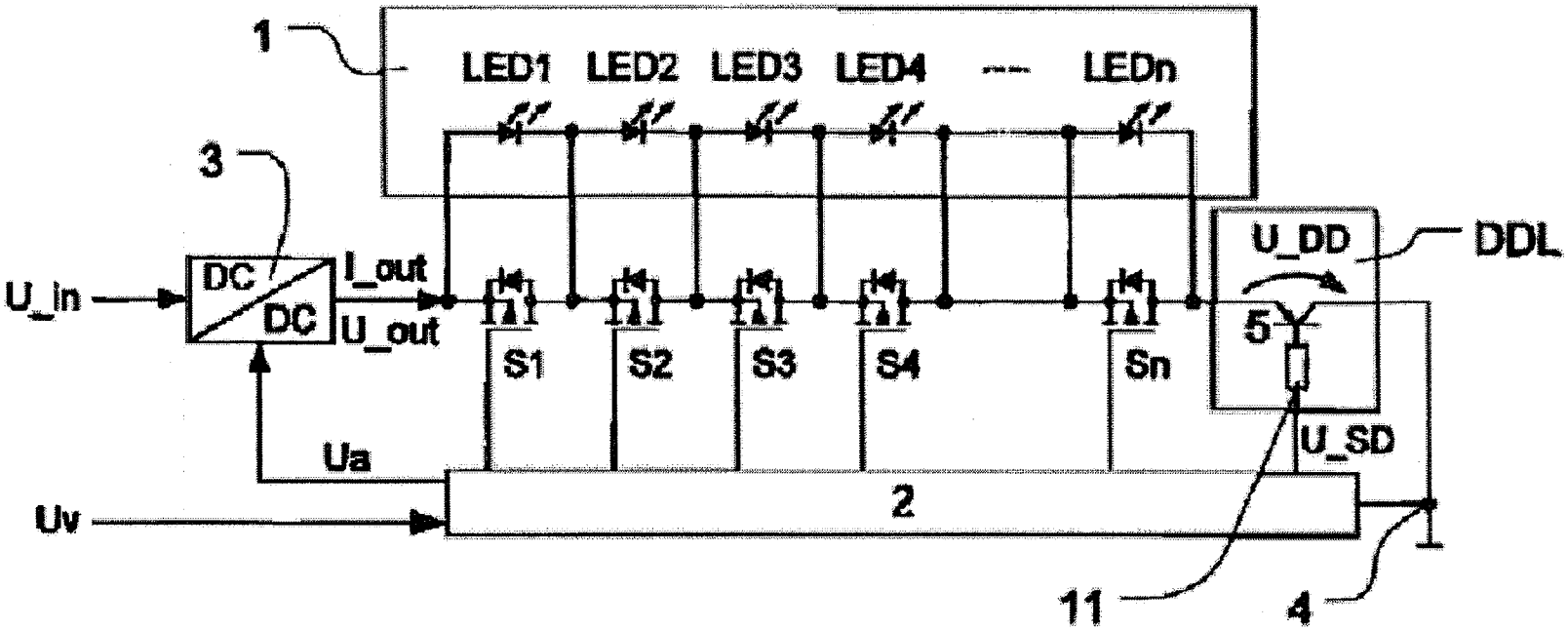
FIG. 8 is a circuit arrangement with a dynamic dummy load.

FIG. 8 illustrates another embodiment of the dummy load. In the embodiment as per FIG. 8, the dummy load is embodied as a dynamic dummy load DDL. A unit having a variable electrical resistance can be used as dynamic dummy load DDL. Thus a controllable potentiometer or a semiconductor element or a semiconductor circuit or a semiconductor or an operational amplifier can be used. In FIG. 8, in an advantageous example embodiment the dynamic dummy load DDL is embodied in the form of a transistor 5 whose base is controlled by control unit 2 via a resistor 11. In another advantageous embodiment of the invention, the control of the dynamic dummy load DDL is accomplished via a port of control unit 2, wherein in this case the control unit 2 is embodied as microcomputer, microcontroller or integrated circuit. In the embodiment of the dynamic dummy load DDL in the form of the transistor 5, said transistor is directly controlled by the port of the control unit 2 via the resistor 11 at the base of the transistor 5, preferably by means of a PWM signal (pulse-width modulated signal). This PWM signal is a voltage signal and is symbolized by U_SD. Alternatively, it is also possible to control the transistor using an analog signal that is generated in control unit 2. This analog signal is a voltage signal and is symbolized by U_SD.

The embodiment as per FIG. 8 advantageously exploits the fact that the driver stage 3 is configured as a constant current source. Although the constant current source cannot immediately compensate for an abruptly appearing voltage rise without producing at least a small current break, it is however very capable of correcting an increase that is slow in relation to the control constant and holding the output current I_out and therefore the "luminous flux" nearly constant.

This circumstance, that the driver stage 3 cannot immediately compensate for an abruptly appearing voltage rise without producing at least a small current break but is however very capable of correcting an increase that is slow in relation to the control constant, is now exploited by using the dynamic dummy load DDL.

Figure 9:
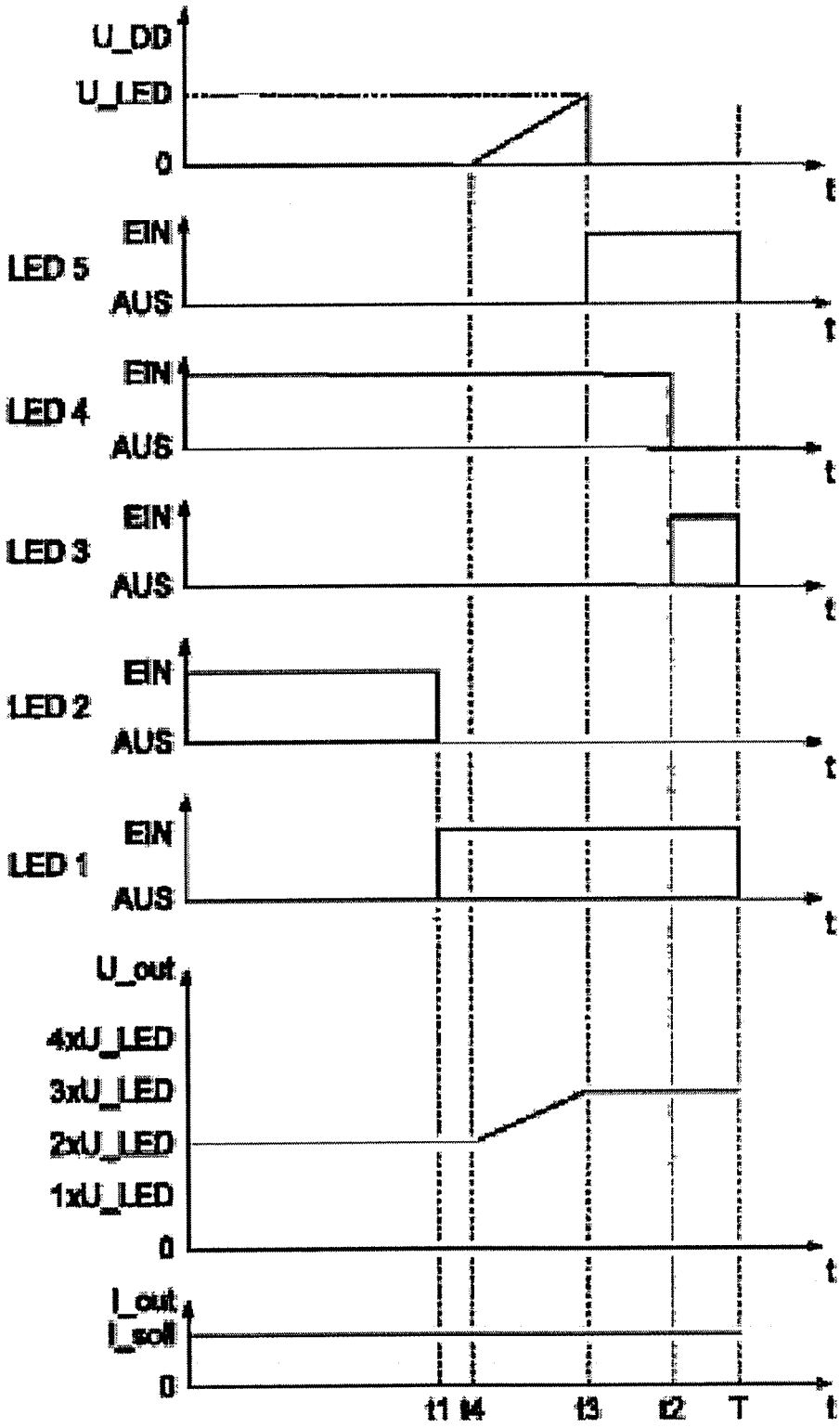
FIG. 9 is signal curves with dynamic dummy load.

FIG. 9 illustrates the signal curves of the voltage U_out, which must be provided by the driver stage 3, and of the output current I_out and of the switching states of the single loads LED1 to LED5 and of the dynamic load DDL over a time interval 0-T. Load surges are avoided by skillfully switching the single loads LED1 to LED4 on and off, similarly as in the preceding description. The dynamic dummy load DDL now compensates for the load surge, which arises when switching on and switching off the single load LED5, to which no other single load can be assigned for compensation and with contrary switching performance.

To compensate for or prevent the load surge that would appear if the single load LED5 is switched on at time t3, the resistance value of the dynamic dummy load DDL is now, beginning at time t4, continuously increased in the period t4 to t3 starting from resistance value zero until it corresponds to the resistance value that the single load LED5 will have when switched on at time t3. The voltage drop U_DD, which drops on the dynamic dummy load DDL, is therefore continuously increased during the period t4 to t3 until the voltage that will drop when operating the single load LED5 drops on the dynamic dummy load DDL. The control unit 2 will then cut out the dummy load DDL simultaneously with the switching on of the single load LED5, i.e. the electrical resistance value of the dummy load DDL is set to zero so that a load surge when switching on the single load LED5 is nearly prohibited. The increase of the voltage drop U_DD across the dynamic dummy load DDL is chosen so as not to exceed the ability of the driver stage 3 to provide control. The increase of the control voltage U_SD in FIG. 8 leads to a rise of the voltage U_DD, which drops across the dynamic dummy load DDL. The voltage U_DD to be expected corresponds to the forward voltage of the single load LED5 connected at time t3 if said load is embodied as a light-emitting diode. The control voltage U_SD is now shut off at time t3 so that the voltage drop U_DD reduces itself to zero, the single load LED5 being switched on at the same time. No load surge arises.

The switching on of the single load LED5 takes place nearly without load surge because of the coordination between the voltage drop U_DD at the dynamic dummy load DDL and the voltage drop on the single load LED5. The choice of the time t4 depends on the required voltage jump and the nature of the driver stage 3 and its ability to compensate for voltage rises. Depending on the voltage difference to be expected, the voltage drop across the dynamic dummy load DDL can be chosen variable so that the dynamic dummy load DDL can compensate for an individual electrical property of a single load to be switched on.

In the embodiment as per FIG. 9, the voltage drop across the dynamic dummy load DDL is embodied linearly. In an advantageous embodiment of the invention, it is provided that other shapes of increase, such as an S-shaped increase or an exponential or logarithmic increase lead to even lower loads on the driver stage 3.

Because of the flexible adjustment of the voltage drop U_DD across the dynamic dummy load DDL, it is now possible in an advantageous embodiment to compensate for more than only the load surge of one single load when switching on. In particular, it is possible for example to compensate for a plurality of LED forward voltages or greatly different LED forward voltages.

Figure 10:
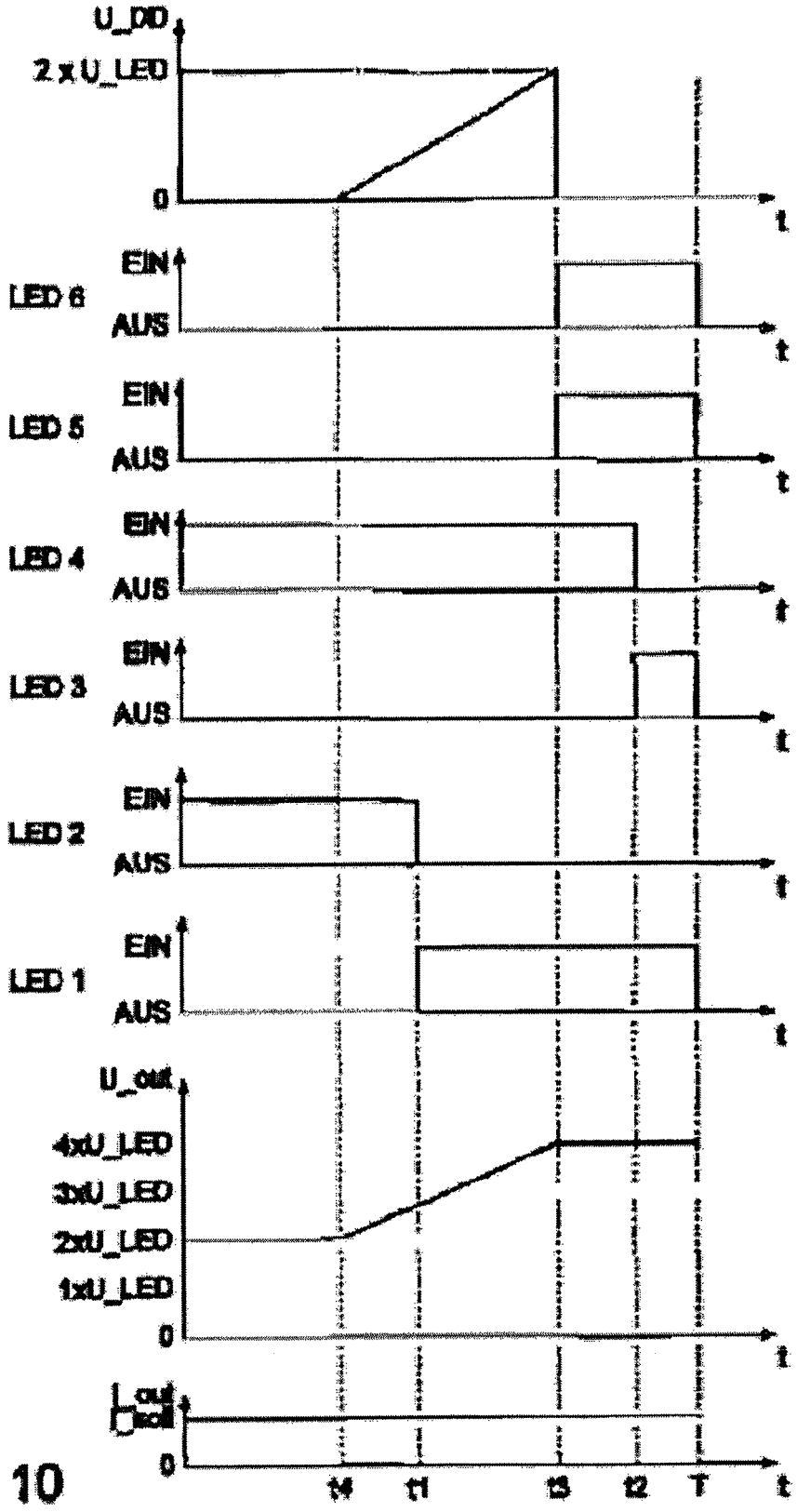
FIG. 10 is other signal curves with dynamic dummy load.

FIG. 10 illustrates such a procedure based on a concrete example embodiment.

In the example embodiment as per FIG. 10, another single load LED6 is switched on in contrast to the embodiment in FIG. 9. Now two single loads LED5 and LED6 are additionally switched on in unison. The dynamic dummy load DDL compensates for the load surge that arises from this. In an advantageous embodiment of the invention, two single loads LED5, LED 6, for example, can be controlled by means of one common controllable switch connected in parallel. The voltage rise when mutually switching on the two single loads, as depicted in FIG. 10, corresponds to the sum of the voltage drops across each of the single loads LED5 and LED6. These voltages are equal in the example embodiment. In the time period t4-t3, the dynamic dummy load DDL is now brought to the resistance value that corresponds to the voltage drop across the two single loads LED5 and LED6 when they are switched on. The activation time for the dynamic load DDL is appropriately shifted so that the voltage difference to be expected at time t3 is reached. As a result, the leading edge of the voltage is not kept too steep, i.e. the needed voltage that is required for the switch-on and which is already supposed to drop across the dynamic dummy load DDL at this time t3 is continuously increased in the period t4 to t3 so that the driver stage 3 can correct without trouble. If the corresponding voltage value is reached on the dynamic dummy load DDL, at time t3 in FIG. 10, then it is switched off and the single loads LED5, LED6 are switched on simultaneously. It can be seen that no load surge arises from this; the voltage U_out of the driver stage 3 remains nearly constant, and the desired output current I_out likewise remains nearly constant.

By using the dynamic dummy load DDL, it is also possible to compensate for nearly every load surge in the form of a voltage rise and/or voltage drop that arises from switching on or switching off a single load. It is only necessary to adjust a corresponding load matching by means of the dynamic dummy load DDL.

Figure 11:
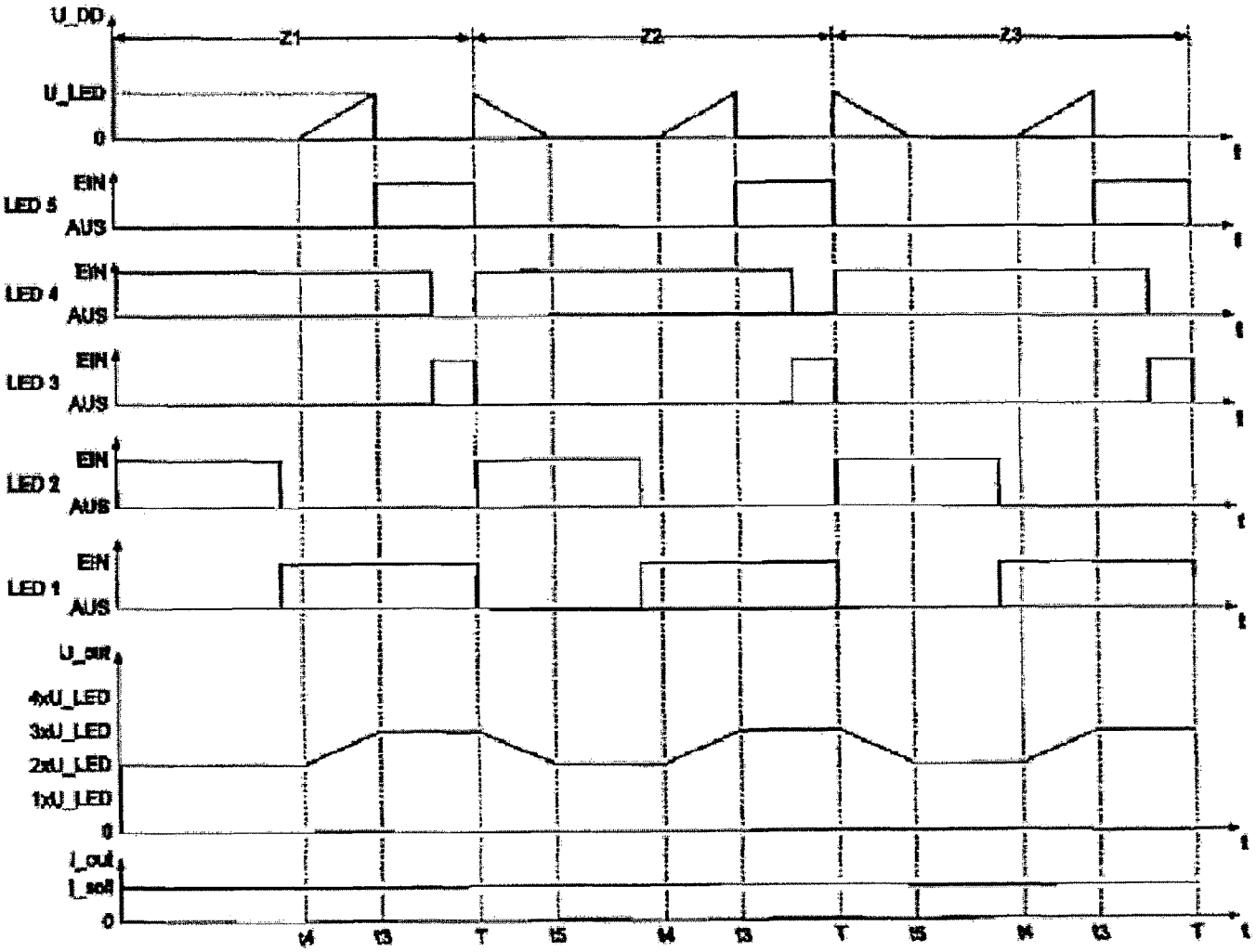
FIG. 11 is signal curves with dynamic dummy load over a longer time period.

FIG. 11 now illustrates another embodiment in the form of a dynamic adaptation of the dynamic dummy load DDL for a switch-on or switch-off process of a single load.

FIG. 11 depicts the output voltage U_out of the driver stage 3 and output current I_out of the driver stage 3 over time over several cycle durations Z1 to Z3. The switching states of the single loads LED1 to LED5 are depicted above it. The figure also depicts the voltage drop U_DD across the dynamic dummy load DDL. Within one of the periods Z, the single loads LED1 to LED4 are switched on and off oppositely to one another in a manner already described so that a load surge is prevented. In each of the periods Z, the single load LED5 is now switched on at each time t3 and switched off at time T. The dynamic dummy load DDL compensates for the load surges that arise from this. This is accomplished in that, before the single load LED5 is switched on, the voltage drop on the dynamic dummy load DDL is brought to the voltage to be expected, the voltage that the single load LED5 causes when switched on. At the time that the single load LED5 is switched on, the dynamic dummy load DDL is switched off. A load surge is prevented.

When the single load LED5 is switched off at time T, the dynamic single load DDL is simultaneously adjusted to the resistance value that produces a voltage drop on the dynamic dummy load DDL corresponding to the voltage drop across the single load LED5 when in operation, and the dynamic dummy load DDL is simultaneously switched on at time T when the single load LED5 is switched off. Here too a load surge is prevented. In the succeeding period after T, the dynamic dummy load DDL linearly reduces the voltage drop U_DD to zero.

FIG. 11 depicts several periods Z1 to Z3 in sequence. Each period Z1 to Z3 corresponds to one time interval T.

By activating the dynamic dummy load DDL with the voltage drop U_DD until time t3 and switching on the single load LED5 and simultaneously switching off the dynamic dummy load DDL, the load surge, which would otherwise arise when switching on the single load LED5 at time t3 and for which the driver stage 3 would have to provide compensation, is warded off. The similar occurs when the single load LED5 is switched off.

The output voltage U_out of the driver stage 3 can thus be influenced so that it is possible to compensate for load surges as desired.

The arrangement according to the invention now makes it possible to ward off load surges, which arise due to tolerances of the single loads, when switching over single loads LED1 to LEDn. When using light-emitting diodes in particular, it is thus possible to compensate for existing forward-voltage tolerances.

The voltage surges that arise when switching on and off are known from detecting and/or measuring the forward voltages of the light-emitting diodes and can be compensated by the adaptation of the dynamic dummy load DDL when switching on and off. By adapting the rise times and fall times of the voltage U_DD to the dynamic dummy load DDL, it is possible to attain an optimized adaptation to the electrical power value of the driver stage 3. The harmonic load variation without load surges that this makes possible provides for substantially better power consumption from the voltage supply source, making it possible to design the necessary filter components in a more cost-efficient manner. In addition, the device according to the invention attains an advantageous power balance.

Figure 12:
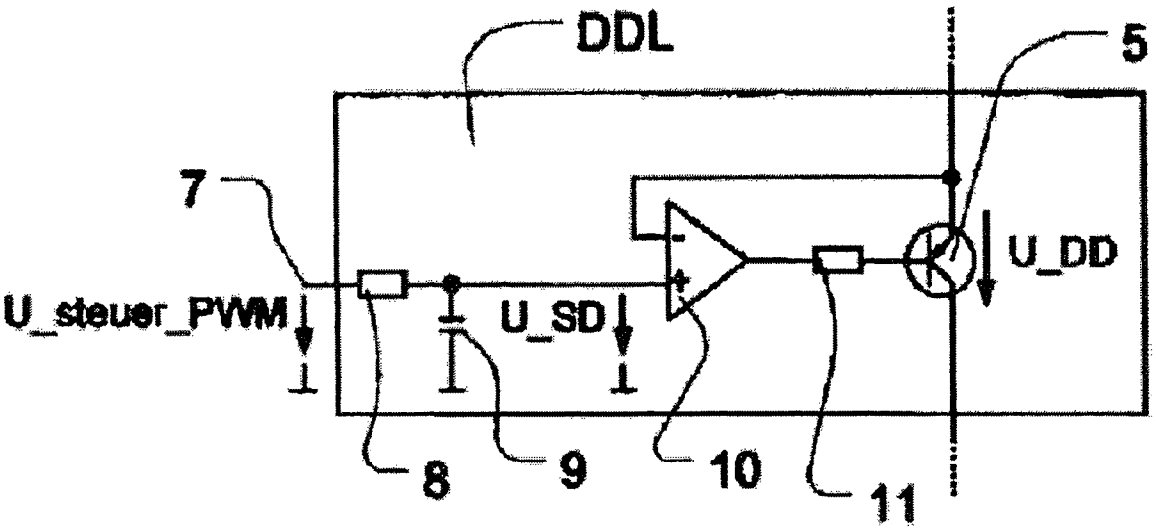
FIG. 12 is an example embodiment of a dynamic dummy load.

For the embodiment of the dynamic dummy load DDL, in one advantageous embodiment of the invention it is configured in the form of a transistor 5 used as a unity-gain amplifier. FIG. 12 illustrates this type of circuit and embodiment of the dynamic load DDL. The control of the dynamic dummy load DDL is accomplished through a pulse-width modulated signal, preferably generated by the control unit 2, there preferably generated through a port 7 of the control unit 2.

In an advantageous embodiment, the control unit 2 is embodied as microcomputer or microprocessor and an output port serves for control of the dynamic dummy load DDL, preferably in the form of a pulse-width modulated voltage signal. This signal is labeled as U_control_PWM. The base of the transistor 5 is connected to an RC element consisting of a resistor 8 and a capacitor 9 via a resistor 11 and an operational amplifier 10, the negative input of which is connected to the collector of the transistor 5 and the output of which is conducted to the base of the transistor via the resistor 11.

The RC element serves to filter the pulse-width modulated voltage signal U_control_PWM. As illustrated, it can thus be directly generated by a microprocessor and its port 7.

Figure 13:
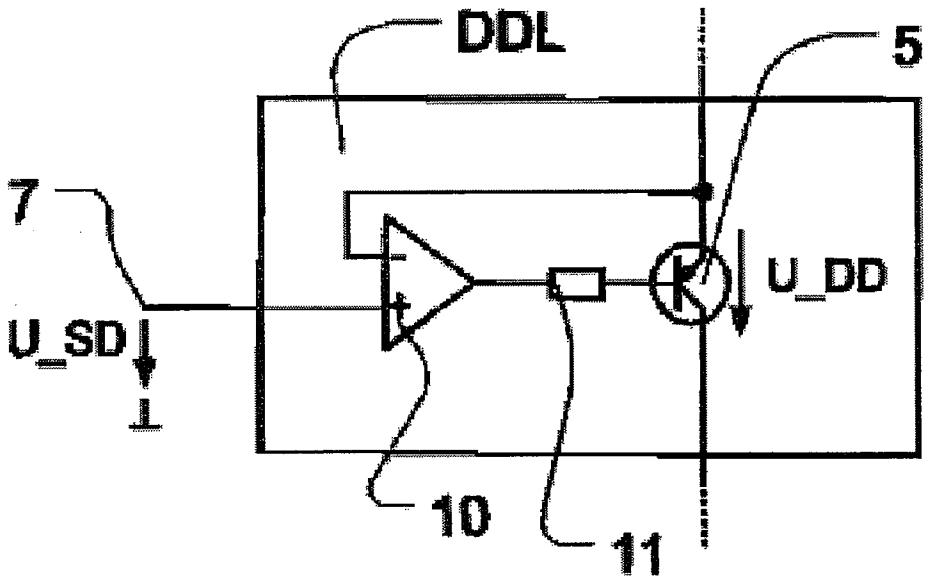
FIG. 13 is another example embodiment of a dynamic dummy load.

In another embodiment, as illustrated in FIG. 13, it is possible to dispense with the RC element, and a DA converter in the control unit 2 can generate the voltage U_SD directly. This DA converter can be integrated in a microprocessor.

Figure 14:
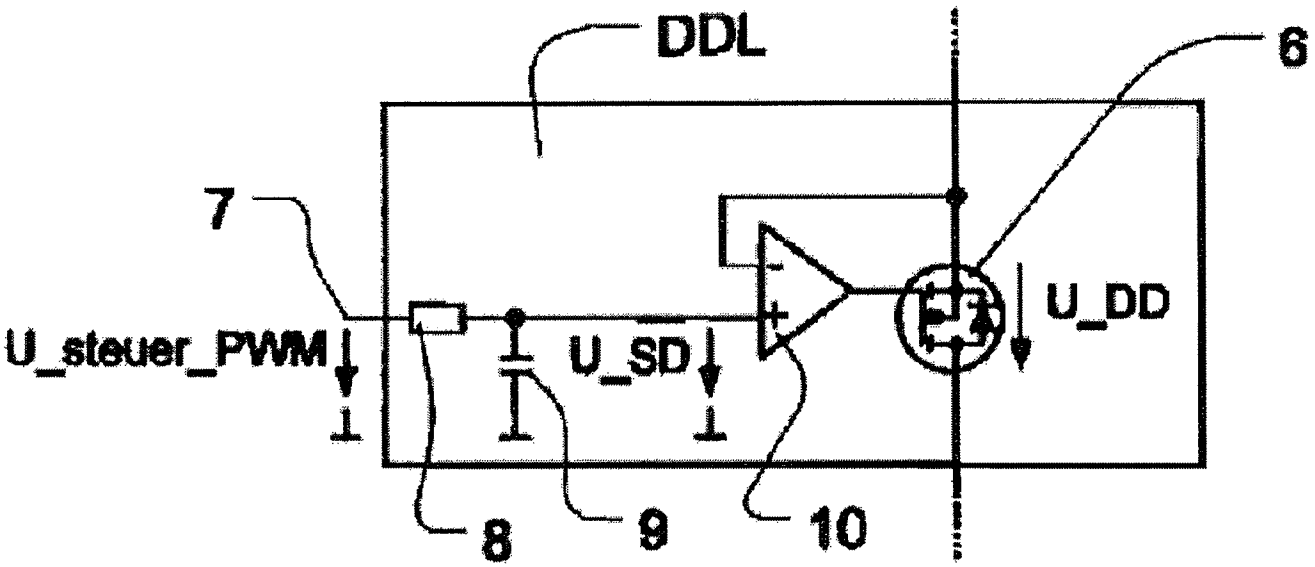
FIG. 14 is another example embodiment of a dynamic dummy load.

FIG. 14 illustrates another embodiment of a dynamic dummy load DDL. As per FIG. 14, a field-effect transistor 6 replaces the transistor of FIG. 12. Using the field-effect transistor 6 avoids the disadvantage of the transistor 5 of FIG. 12 and its high voltage drop, which corresponds to the saturation voltage of transistor 5. The advantage of the field-effect transistor 6 is that a nearly load-free control is possible. An RC element, made of a resistor 8 and a capacitor 9 connected to ground, likewise filters the control voltage U_control_PWM.

Figure 15:
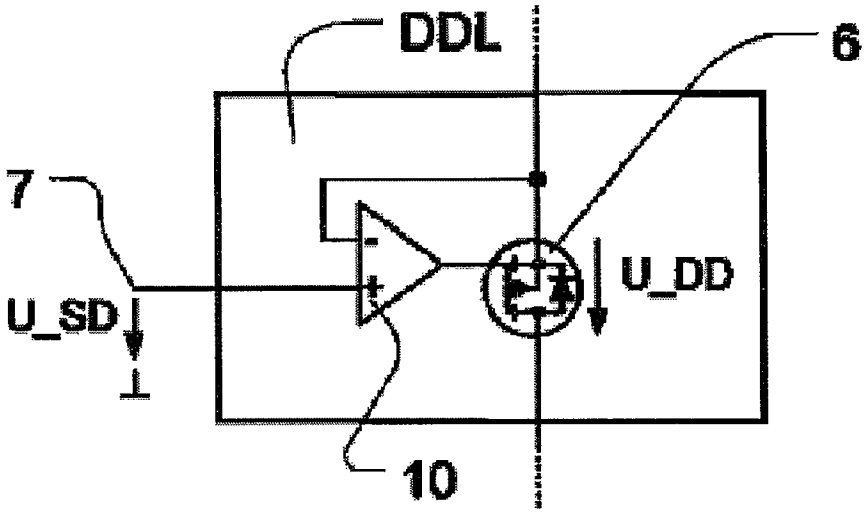
FIG. 15 is another example embodiment of a dynamic dummy load.

Here too, as illustrated in FIG. 15, it is possible in another embodiment to dispense with the RC element and generate the voltage U_SD directly by means of a DA converter in the control unit 2. This DA converter can be integrated in a microprocessor.

LIST OF REFERENCE CHARACTERS

LED1-LEDn—single load
DL—dummy load
DDL—dynamic dummy load
U_SD—control voltage
U_control_PWM—pulse-width modulated control voltage
U_DD—voltage drop on the dynamic dummy load
S1 . . . Sn—controllable switches
DS—controllable switch of the dummy load
Uv—supply voltage
U_in—input voltage
U_out—output voltage
I_out—output current
I_desired—desired current
Ua—control signal
UD—voltage
1—electrical load
2—control unit
3—driver stage
4—current measuring point
5—transistor
6—field-effect transistor
7—port
8—resistor
9—capacitor
10—operational amplifier
11—resistor
t1-t5, T—times
Z—periods The principle and mode of operation of this invention have been explained and illustrated in its preferred embodiment. However, it must be understood that this invention may be practiced otherwise than as specifically explained and illustrated without departing from its spirit or scope.

What is claimed is:

1. Device for controlling an electrical load comprising:

at least two single loads, wherein the at least two single loads are connected in series and each of the at least two single loads is connected in parallel to a controllable switch so that each of the at least two single loads is configured to be switched independently of one another, a driver stage, which drives a current into the electrical load, and a control unit, which controls the controllable switches, wherein at least one dummy load is connected in series to the at least two single loads and is configured to be switched when one of the at least two single loads is switched to prevent load surges.

2. Device according to claim 1, wherein the electrical resistance value of the dummy load corresponds to the electrical resistance value of one of the at least two single loads, or the electrical resistance of the dummy load corresponds to an integral multiple or a fraction of the electrical resistance value of one of the at least two single loads.

3. Device according to claim 1, wherein the dummy load is rated so that at a nominal voltage, the dummy load assumes the same electrical variable that corresponds to the operating voltage drop across one of the at least two single loads or to an integral multiple thereof.

4. Device according to claim 1, wherein the dummy load is a static dummy load and has a constant electrical variable, and wherein a controllable switch, which is configured to be controlled by the control unit, is connected to the dummy load.

5. Device according to claim 4, wherein the electrical variable is the electrical resistance value.

6. Device according to claim 4, wherein the control unit closes the controllable switch of the static dummy load when it opens one of the controllable switches of the at least two single loads, and/or the control unit opens the controllable switch of the static dummy load when it closes one of the controllable switches of the at least two single loads.

7. Device according to claim 4, wherein the control unit performs the closing and opening of the controllable switch of the static dummy load simultaneously with the opening and/or closing of one of the controllable switches of the at least two single loads.

8. Device according to claim 1, wherein the dummy load is a dynamic dummy load with a variable electrical variable which is configured to be varied by means of the control unit.

9. Device according to claim 8, wherein when closing or opening a last one of the controllable switches of the at least two single loads, the control unit adjusts the dynamic dummy load to the electrical resistance value that corresponds to the electrical resistance value held in the operating state by that one of the at least two single loads whose associated controllable switch is closed or opened by the control unit.

10. Device according to claim 8, wherein the dynamic dummy load is configured to be flexibly adapted to different electrical loads, and that electrical loads with different voltage drops are configured to be combined.

11. Device according to claim 8, wherein the control unit activates the dynamic dummy load time-displaced before the cut-in of one or more single loads in order to avoid a discontinuous voltage rise.

12. Device according to claim 8, wherein the dynamic dummy load is suitable not only for compensating for the voltage rise, but also for reducing the output voltage after the cut-off of one or more single loads or loads with different voltage drops.

13. Device according to claim 8, wherein the voltage drop on the dynamic dummy load is configured to be changed linearly or nonlinearly in the form of an S curve, exponentially, logarithmically, or step-like.

14. Device according to claim 1, wherein the control unit performs the initial switch-on and the entire switching off of the at least two single loads of the electrical load individually, sequentially, or together or in groups.

15. Device according to claim 1, wherein the control unit uses a current measuring unit to monitor the electrical current flowing in the electrical load at a current measuring point and, by means of a target-performance comparison, uses the driver stage to adjust said electrical current to an adjustable setpoint so that a current that is substantially constant flows into the electrical load.

16. Device according to claim 1, wherein a single load is a diode array consisting of a light-emitting diode or at least two light-emitting diodes connected in parallel and/or connected in series and/or matrix-connected.

17. Device according to claim 1, wherein the static dummy load is another single load, or a diode, or a light-emitting diode, or a bipolar transistor in the form of an npn transistor or a pnp transistor, or a field-effect transistor, or a control circuit, or a combination of a bipolar transistor or a field-effect transistor with an associated control circuit, or an electrical resistor.

18. Device according to claim 1, wherein the dynamic dummy load is a bipolar transistor in the form of an npn transistor, a pnp transistor, a field-effect transistor, a control circuit, a combination of a bipolar transistor, a field-effect transistor with an associated control circuit, or an electrical resistor whose electrical resistance value is variable.

19. Device according to claim 18, wherein the dynamic dummy load is configured to be controlled by a pulse-width modulation signal that is configured to be generated by a port of the control unit.

20. Device according to claim 18, wherein the dynamic dummy load is configured to be controlled by an analog signal that can be generated by a port of the control unit, wherein the electrical resistance value that the electrical dummy load assumes is configured to be varied by this signal.

21. Device according to claim 18, wherein the electrically operating resistance value of the bipolar transistor and/or the field-effect transistor is configured to be varied by means of the pulse-width modulation signal, which is configured to be supplied to an operational amplifier by an RC element wherein, in the case of the bipolar transistor, the output of the operational amplifier is conducted to the base of the bipolar transistor by a second resistor and, in the case of the field-effect transistor, it is conducted to the gate.

22. Device according to claim 21, wherein the bipolar transistor is connected in the collector circuit and the field-effect transistor is configured as an n-channel field-effect transistor.

23. Device according to claim 18, wherein the electrically operating resistance value of the bipolar transistor and/or the field-effect transistor is configured to be varied by the analog control signal that is configured to be supplied to an operational amplifier, wherein in the case of the bipolar transistor, the output of the operational amplifier is conducted to the base of the bipolar transistor by a second resistor and, in the case of the field-effect transistor, it is conducted to the gate.

* * * * *